US009510652B2

(12) United States Patent
Schifter

(10) Patent No.: US 9,510,652 B2
(45) Date of Patent: Dec. 6, 2016

(54) PICTURE CREATION METHOD ON A LOCKET

(71) Applicant: Daniel Schifter, Staten Island, NY (US)

(72) Inventor: Daniel Schifter, Staten Island, NY (US)

( * ) Notice: Subject to any disclaimer, the term of this patent is extended or adjusted under 35 U.S.C. 154(b) by 0 days.

(21) Appl. No.: 15/095,341

(22) Filed: Apr. 11, 2016

(65) Prior Publication Data

US 2016/0229196 A1 Aug. 11, 2016

(51) Int. Cl.

| | |
|---|---|
| ***B44C 5/00*** | (2006.01) |
| ***A44C 25/00*** | (2006.01) |
| ***A44C 27/00*** | (2006.01) |
| *B41J 3/407* | (2006.01) |

(52) U.S. Cl.

CPC ..... *A44C 25/004* (2013.01); *A44C 25/002* (2013.01); *A44C 27/006* (2013.01); *B44C 5/00* (2013.01); *B41J 3/407* (2013.01)

(58) Field of Classification Search

CPC .... B41J 3/407; A44C 25/004; A44C 27/006; A44C 25/002; B44C 5/00

See application file for complete search history.

(56) References Cited

U.S. PATENT DOCUMENTS

| | | | | |
|---|---|---|---|---|
| 4,271,684 | A * | 6/1981 | Tisdale | A44C 1/00 623/27 |
| 4,790,088 | A * | 12/1988 | Morvant | G09F 19/22 40/124.5 |
| 5,126,948 | A * | 6/1992 | Mitchell | G05B 19/4207 700/161 |
| 5,429,393 | A | 7/1995 | Parlo | |
| 5,751,436 | A * | 5/1998 | Kwon | H04N 1/10 219/121.68 |
| 6,422,037 | B1 * | 7/2002 | Benderly | A44C 3/00 40/27.5 |
| 7,414,221 | B2 | 8/2008 | Pratt, Sr. et al. | |
| 7,861,385 | B1 | 1/2011 | Meyer | |
| 2007/0283601 | A1 | 12/2007 | Peterson | |
| 2015/0143847 | A1 * | 5/2015 | Weems | A44C 13/00 63/18 |

OTHER PUBLICATIONS

Laser Engraving & Marking, MPS Metal Photo Service, Inc., accessed Feb. 10, 2016.

* cited by examiner

*Primary Examiner* — Alessandro Amari
*Assistant Examiner* — Yaovi M Ameh
(74) *Attorney, Agent, or Firm* — Michael J. Feigin, Esq.; Feigin & Fridman

(57) ABSTRACT

A metal substrate with picture sized to fit within a locket is created by obtaining an insert, such as a manufacturer-provided insert, that is shipped with the locket. Exact dimensions of the insert are obtained electronically through the use of a camera or scanner, and then a metal insert is created on a metal substrate by cutting the metal substrate to the dimensions of the insert. A photograph or other artistic work is then printed on the metal substrate being a version of an electronic such work previously obtained and sized to fit on the substrate. The metal substrate is then inserted into the locket, in embodiments of the disclosed technology.

16 Claims, 6 Drawing Sheets

PICTURE CREATION METHOD ON A LOCKET

FIELD OF THE DISCLOSED TECHNOLOGY

The disclosed technology relates generally to printing and, more specifically, a method of printing a picture in a locket.

BACKGROUND OF THE DISCLOSED TECHNOLOGY

Lockets are jewelry items with two sides which generally are connected by a hinge. Pictures or other artistic creations are usually displayed on the inside face of one or both of the sides of the locket.

SUMMARY OF THE DISCLOSED TECHNOLOGY

A picture is printed into a hinged locket, the locket having an insert sized to fit within the locket when the locket is closed. This insert is generally provided by the manufacturer and shipped with the locket upon purchase, but can also be created, as necessary, and is made out of a paper product (including cardboard) or plastic. A metal insert is then made in its place by acquiring an image of the insert and cutting the metal substrate to dimensions equal to that of the insert. The dimensions are equal in a two-dimensional plane (along an X and Y axis) and, in some embodiments, in three dimensions, meaning that the metal substrate has the same thickness, or substantially the same thickness (along the Z axis). A version of an artistic work, such as a photograph, is received into an electronic form and then printed, such as laser etched, onto the metal substrate, such as one side thereof. The version can include at least a majority of the display of the original artistic work, reduced in size. The metal substrate is then, in embodiments of the disclosed technology, inserted into the hinged locket and/or secured by way of frictional attachment to one of the sides of the hinged locket.

The insert, in embodiments, is substantially a same shape as either side of the hinged locket and fits flat and without bending within the locket in a closed state. The insert can be acquired in electronic form by scanning an image of it with a scanner (line by line optical input device at close range) or by taking an electronic photograph (optical input device at further range). "Close range" is defined as less than three inches, where as "further range" is defined as three inches or greater.

Expressed in a different way, a method of creating an image inside a locket is disclosed. The locket has two halves joined by a hinge. An interior space between the two sides is formed when the two sides are held against each other. A paper insert is sized to fit in the interior space, such as one provided by a manufacturer of the locket and pre-placed within a space for a picture and, in some cases, having a picture printed there-on already. Size and shape parameters (X and Y dimensions and/or named shape information such as "heart") of the insert are determined and stored in an electronic format (in volatile or non-volatile random access memory, solid state memory, magnetic memory, optical memory, or the like).

A photograph is obtained in electronic format (by scanning a physical print or receiving electronically, such as via network nodes and a packet-switched network). A metal substrate is cut or procured to the exact size and shape parameters of the insert. A version of the photograph is then printed on the metal substrate, and the metal substrate is inserted into the locket, such as in place of the insert. The metal substrate, in embodiments of the disclosed technology, is frictionally held into one side of said two sides of said locket.

"Substantially" and "substantially shown," for purposes of this specification, are defined as "at least 90%," or as otherwise indicated. "Identical" or "exactly," for purposes of this specification, is defined as "within an acceptable tolerance level known in the art." Any device may "comprise," or "consist of," the devices mentioned there-in, as limited by the claims. Any element described may be one of "exactly" or "substantially," as described.

It should be understood that the use of "and/or" is defined inclusively, such that the term "a and/or b" should be read to include the sets: "a and b," "a or b," "a," or "b."

DETAILED DESCRIPTION OF EMBODIMENTS OF THE DISCLOSED TECHNOLOGY

A metal substrate with picture sized to fit within a locket is created by obtaining an insert, such as a manufacturer-provided insert, that is shipped with the locket. Exact dimensions of the insert are obtained electronically through the use of a camera or scanner, and then a metal insert is created on a metal substrate by cutting the metal substrate to the dimensions of the insert. A photograph or other artistic work is then printed on the metal substrate being an electronic version of such work previously obtained and sized to fit on the substrate. The metal substrate is then inserted into the locket, in embodiments of the disclosed technology.

Embodiments of the disclosed technology will become clearer in view of the forthcoming description of the figures.

Figure 1:
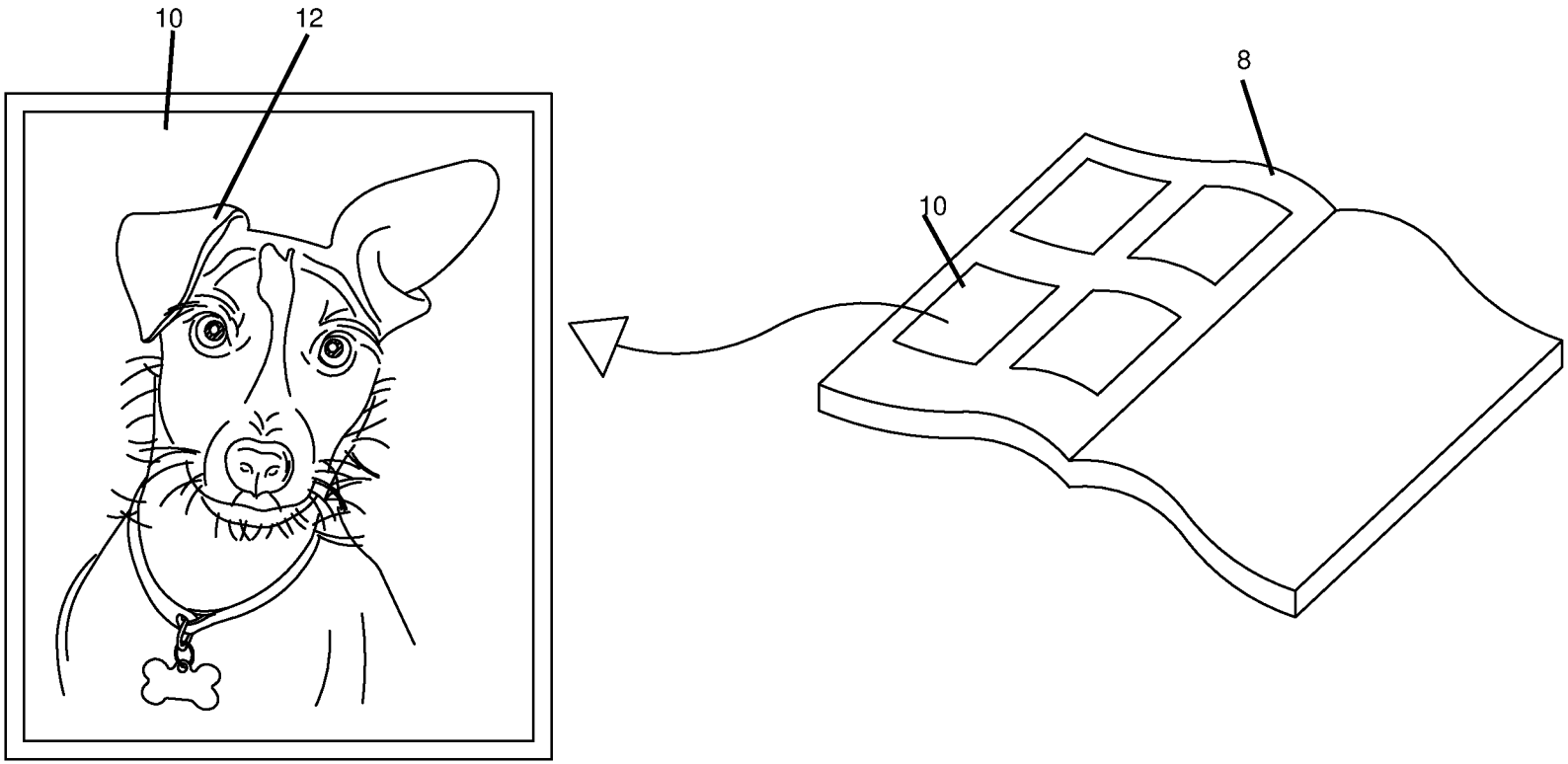
FIG. 1 shows selecting an artistic work, in an embodiment of the disclosed technology.

FIG. 1 shows selecting an artistic work, in an embodiment of the disclosed technology. The artistic work, in this case a photograph 10 from a photo album (whether a printed photo album or electronic photo album) is selected having an image 12. The image 12 is an artistic work or portion of a photograph to be reproduced in a locket.

Figure 2:
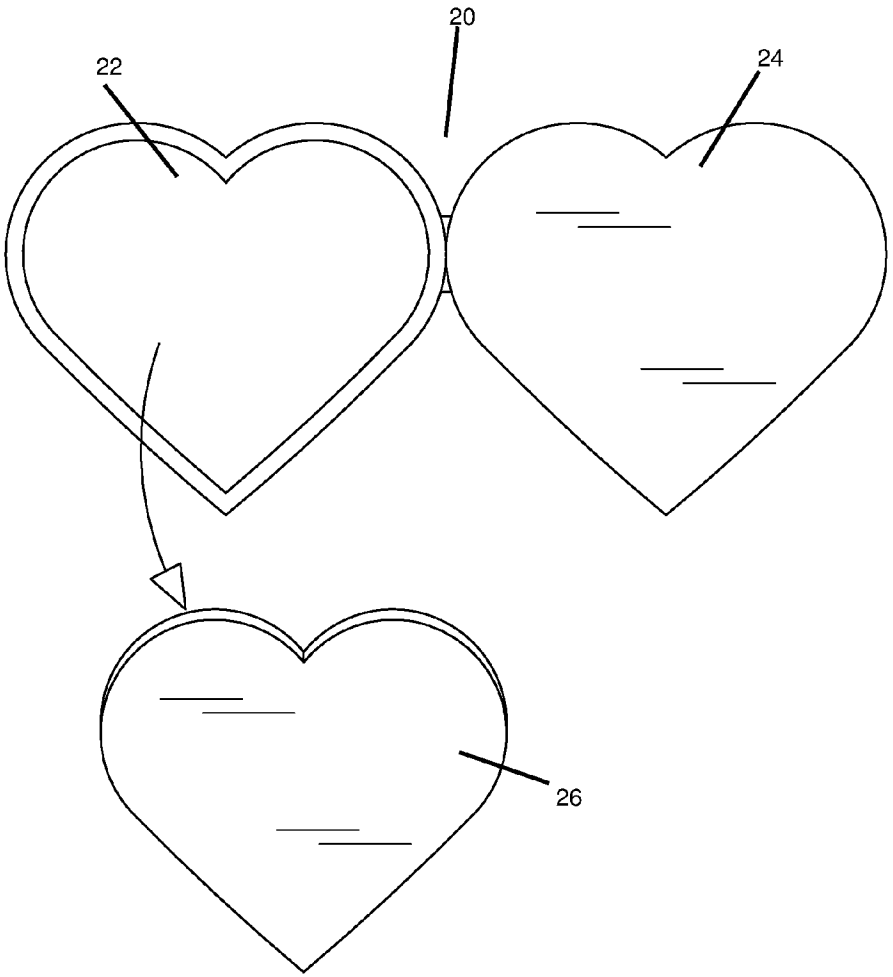
FIG. 2 shows removal of an insert from a locket, in an embodiment of the disclosed technology.

FIG. 2 shows removal of an insert from a locket, in an embodiment of the disclosed technology. Here, the locket 20 has two sides, a rear side 22 and front size 24, with substantially or exactly equal shapes and dimensions on at least two axes (e.g., a heart with the same length and width). "Exact," for purposes of this disclosure, is defined as within acceptable tolerance levels in the art of jewelry sales. The front and rear sides are connected by a hinge (shown between the two hearts in the figure) and close on to one another, such that the shape of each lines up with each other at least on the inner sides there-of, where the two sides 22 and 24 of the locket 20 meet. Note that one side of the locket, the rear side 22, can have a lip extending there-around which engages with the other side 24 of the locket and holds a picture or image there-in. A picture held-therein can be frictionally held by pressing it into the lip of the side 22.

The insert 26 is a paper insert, in embodiments of the disclosed technology. This includes cardboard or other pliable material, which is procured from pulp of a tree or plastic procured from the oil remains of organic matter, or which is synthetically produced. The insert 26 is sized to fit within the rear side 22 of the locket 20 and, in embodiments, ships with a locket from the manufacturer thereof and, when placed within the rear side of the locket, is frictionally held therein either under a frame or lip area described above, or there-against by way of frictional engagement against the inside of the lip or edges of the rear side 22 of the locket 20. This insert is removed and its dimensions determined with exactitude, as described with reference to the following figures.

Figure 3:
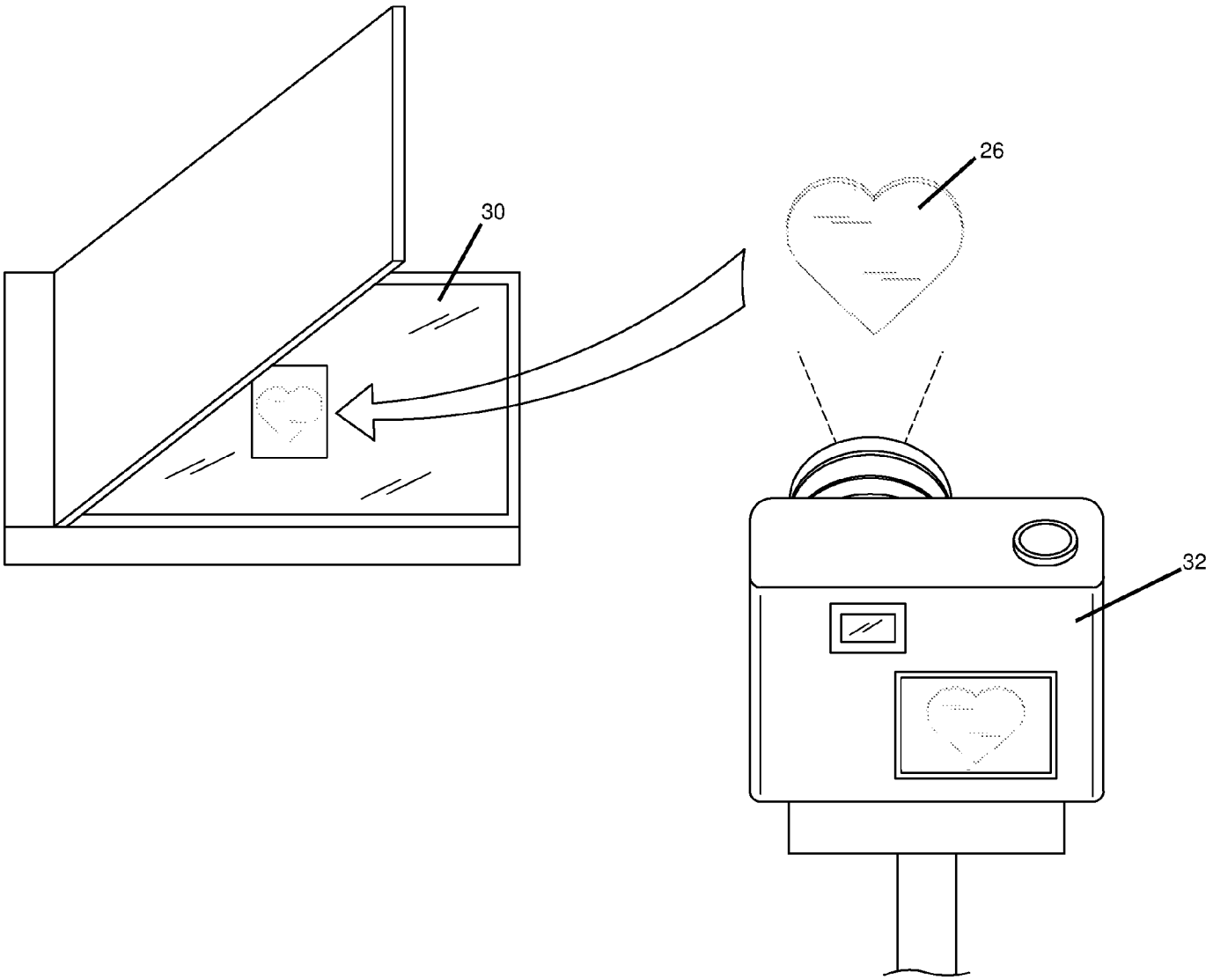
FIG. 3 shows digitally obtaining size information for the insert, in an embodiment of the disclosed technology.

FIG. 3 shows digitally obtaining size information for the insert, in an embodiment of the disclosed technology. Here, the insert 26 is photographed with a camera 32 and/or scanned with scanner 30. By knowing the distance of the insert 26 from the optical receiver (whether on a camera or scanner) the size of the insert 26 can be determined. An electronic replica of the two dimensional elongated side of the insert 26 is received, and this is used as a template for cutting a metal substrate to be placed into the locket 20, and/or printing the image 10 on a metal substrate or other insert to be placed into the locket. Suffice it to say, for a plurality of lockets of the same size, one need only carry out the steps of obtaining the electronic version of the insert 26 one time for all of the metal substrates or images to be printed in a plurality of lockets 20 of the same dimension. That is, one insert 26 will suffice for obtaining a proper size for producing as many metal substrates as desired for placement into one or more lockets.

Before discussing the next figure, it should be understood that "electronic" refers to having a version of an image or physical and tangible device with parameters of its size, shape, thickness, image displayed thereon, or any other characteristics stored via magnetic, optical, or other medium in digital or analog form, such as in non-volatile or volatile random access memory, a hard drive, an optical disk, solid state media, or the like. These data are stored in a way which can later be retrieved to create another version thereof (the stored information), in the physical world. Thus, by way of example, size data about an insert 26 can be obtained electronically by a scanner and employed to size a piece of metal to be used to print an image there-on and deposit within a locket 20.

Figure 4:
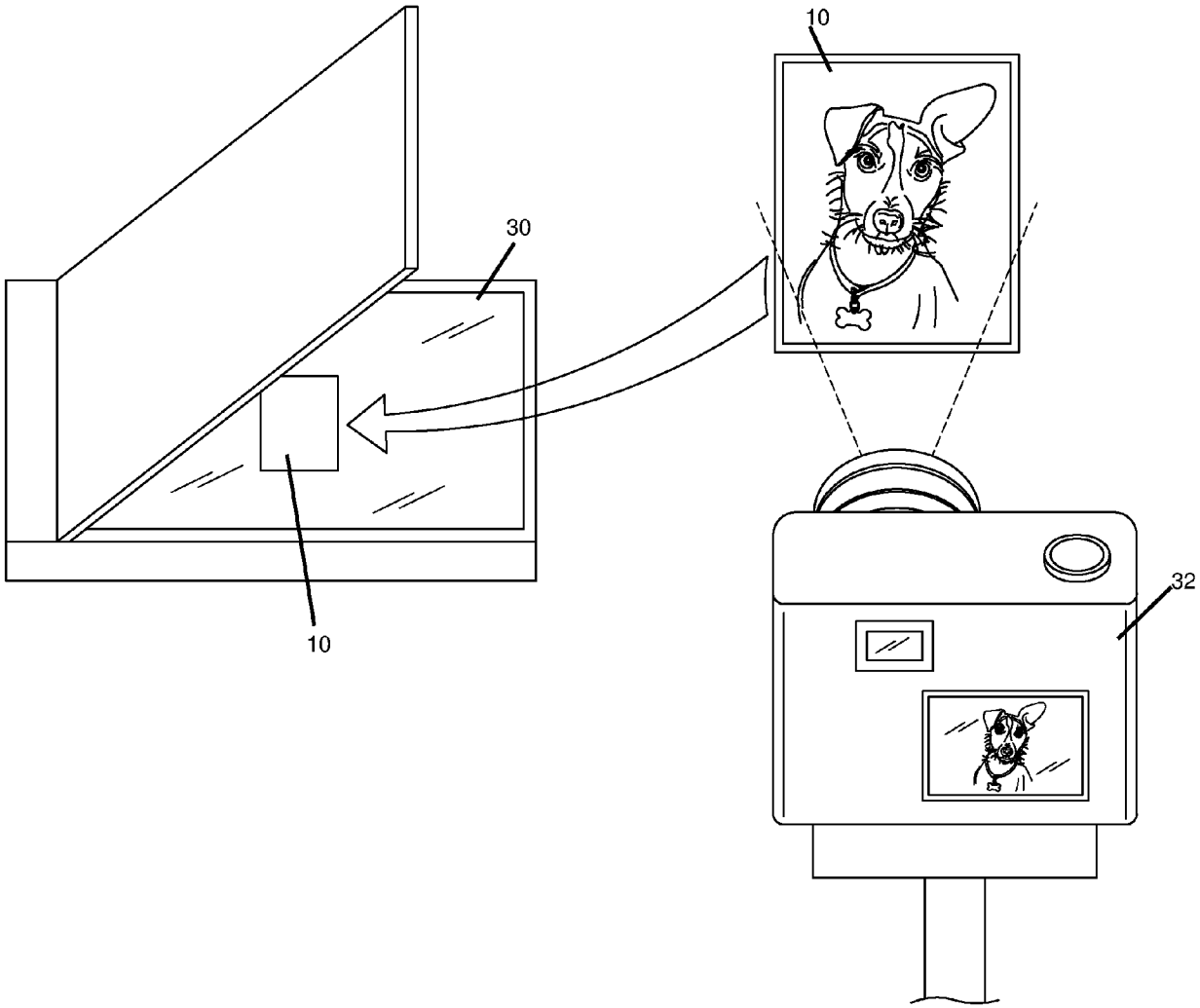
FIG. 4 shows digitally obtaining a version of the artistic work, in an embodiment of the disclosed technology.

FIG. 4 shows digitally obtaining a version of the artistic work, in an embodiment of the disclosed technology. Here, the image 10 is converted into electronic format by a camera 32 or scanner 30. This step is carried out when the image is in print format. When the image 10 is produced in electronic format already, this step is not required, or is carried out by taking a picture with the camera 32 of an actual subject to create an artistic creation, rather than by photographing an already existing photograph.

Figure 5:
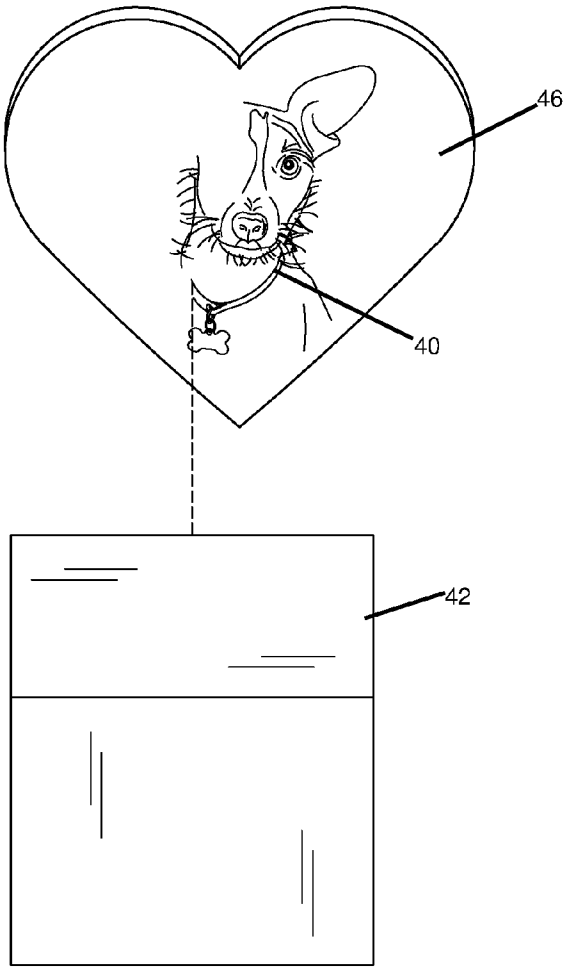
FIG. 5 shows laser transfer of the image on a metal substrate, in an embodiment of the disclosed technology.

FIG. 5 shows laser transfer of the image on a metal substrate, in an embodiment of the disclosed technology. Here, a metal substrate 46 is cut to the exact dimensions as the insert 26, at least with respect to its length and width (a two-dimensional cross-section of the elongated and generally flat side). The depth may also be equal, or substantially equal, to that of the insert 26, thus being exact, or substantially exact, in three dimensions. A laser etching or printing machine 42 is used, in embodiments of the disclosed technology, to print a version of the image 10, in this case the version being image 40, on the metal substrate 46. The image 10 can be cropped or scaled, and the color palette may be changed or reduced, if necessary, to produce the version of the image 10 in the form of image 40.

Figure 6:
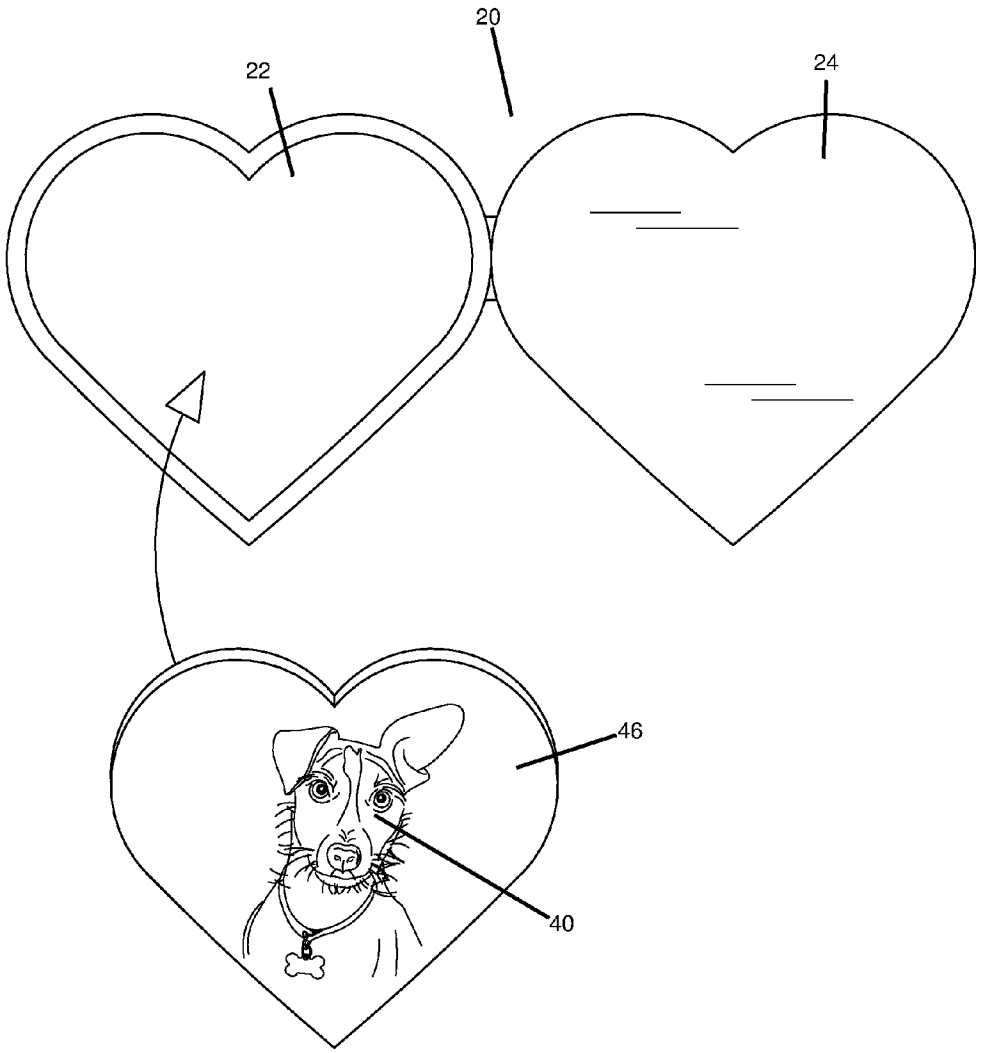
FIG. 6 shows insertion of the metal substrate into a locket in an embodiment of the disclosed technology.

FIG. 6 shows insertion of the metal substrate into a locket, in an embodiment of the disclosed technology. Here, the metal substrate 46, sized to be like that of the insert 26, is placed into the locket 20 and more specifically, into the rear side 22 of the locket, by way of frictionally holding the metal substrate 46 against the edges of the locket's rear side 22. The metal used for the metal substrate 46 can be substantially the same in composition, or have the exact composition as that of the interior side or exterior side of the locket, so as to be uniform with the locket. In this manner, the image appears to be printed onto, or part of, the locket 20 itself. In some embodiments, the background of the image is blank, so that the metal substrate 46 outside of the area of the image (in this case, image 40) has an exact or identical color as that of surfaces of the locket.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A method of printing a picture onto a locket comprising the steps of:

obtaining a hinged locket with insert, said insert sized to fill the inside of said locket when said locket is closed;

acquiring an image of said insert by at least one of scanning an image of said insert and photographing said insert;

cutting a metal substrate to dimensions equal to that of said insert as captured in said image of said insert;

obtaining an electronic version of an artistic work;

printing a version of said artistic work on said metal substrate, and inserting said metal substrate into said hinged locket.

2. The method of claim 1, further comprising a step of removing said insert from said locket, and inserting said metal substrate into said hinged locket in place of said insert.

3. The method of claim 2, further comprising a step of securing said substrate to one side of said hinged locket by way of frictional attachment.

4. The method of claim 2, wherein said step of inserting comprises filling a hollow in said locket with said substrate.

5. The method of claim 1, wherein said insert is substantially a same shape as either side of said hinged locket.

6. The method of claim 5, wherein said insert fits flat and without bending within said locket in said closed state.

7. The method of claim 6, wherein said insert is received with said locket from a manufacturer of said locket.

8. The method of claim 1, wherein said artistic work is a personal photograph.

9. The method of claim 1, wherein said dimensions of said metal substrate are equal to that of said insert in at least two dimensions.

10. The method of claim 9, wherein said dimensions of said metal substrate are equal to that of said insert in three dimensions.

11. A method of creating an image inside a locket, said locket having two halves joined by a hinge and interior space between said two sides, when said two sides are held against each other, said method comprising:

obtaining a paper insert sized to fit in said interior space;

obtaining size and shape parameters of said insert and storing same in an electronic format, said size and shape parameters being determined based on a photograph or scan of said insert;

obtaining a photograph in electronic format;

cutting a metal substrate to said size and shape parameters of said insert;

printing a version of said photograph on said metal substrate;

inserting only said metal substrate in said locket, such that said metal substrate fills said interior space of said locket.

12. The method of claim 11, wherein said metal substrate has dimensions equal to that of said insert on at least a two-dimensional plate.

13. The method of claim 12, wherein said metal substrate is frictionally held into one side of said two sides of said locket.

14. The method of claim 11, wherein said version of said photograph is printed on a portion of a side of said metal substrate, a remainder of said side of said metal substrate being visibly exposed.

15. The method of claim 14, wherein said metal substrate is of the same composition as a majority of said locket.

16. A method of printing a picture onto a locket comprising the steps of:

obtaining a hinged locket with insert, said insert sized to fit within a hollow in said locket and to lie flat without bending therein when said locket is closed, said insert being substantially a same shape as either side of said hinged locket;

acquiring an image of said insert by at least one of scanning and image of said insert and photographing said insert;

cutting a metal substrate to dimensions equal in three dimensions to those of said insert as captured in said image of said insert, said metal substrate being of the same composition as a majority of said locket;

obtaining an electronic version of an artistic work;

printing a version of said artistic work on said metal substrate;

removing said insert from said locket;

inserting said metal substrate into said hinged locket in place of said insert, such that said metal substrate fills said hollow; and securing said substrate to one side of said hinged locket by way of frictional attachment.

* * * * *